US006361246B1

(12) United States Patent
Tamura et al.

(10) Patent No.: US 6,361,246 B1
(45) Date of Patent: Mar. 26, 2002

(54) TIRED ROLLER

(75) Inventors: Seiji Tamura; Kiyoshi Hirasawa, both of Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/125,290

(22) PCT Filed: Dec. 17, 1997

(86) PCT No.: PCT/JP97/04657

§ 371 Date: Aug. 14, 1998

§ 102(e) Date: Aug. 14, 1998

(87) PCT Pub. No.: WO98/27283

PCT Pub. Date: Jun. 25, 1998

(30) Foreign Application Priority Data

Dec. 17, 1996 (JP) ..... 8-337096

(51) Int. Cl.[7] ..... E01C 19/23
(52) U.S. Cl. ..... 404/132; 404/122
(58) Field of Search ..... 404/122, 83, 132; 182/127; 52/182; 280/163, 164.1, 164.2, 166, 169; 296/190.01

(56) References Cited

U.S. PATENT DOCUMENTS

| | | | | | |
|---|---|---|---|---|---|
| 2,359,519 | A | * | 10/1944 | Greiner | 404/122 |
| 2,534,507 | A | * | 12/1950 | Essick | 404/122 |
| 3,291,014 | A | * | 12/1966 | Paramythioti | 404/122 |
| 4,114,716 | A | * | 9/1978 | Sanders | 280/163 |
| 4,125,175 | A | * | 11/1978 | Ernst | 52/182 |
| 4,266,884 | A | * | 5/1981 | Tuneblom | 404/122 |
| 4,619,552 | A | * | 10/1986 | Sadahiro | 404/122 |
| 5,088,855 | A | * | 2/1992 | Giliberti | 404/122 |
| 5,104,257 | A | * | 4/1992 | Martinez et al. | 404/122 |
| 5,397,198 | A | * | 3/1995 | Bertrand | 404/122 |
| 5,797,699 | A | * | 8/1998 | Blancke et al. | 404/122 |

FOREIGN PATENT DOCUMENTS

| | | | | |
|---|---|---|---|---|
| AT | 135910 | * | 8/1933 | 52/182 |
| JP | 7-38205 | | 7/1995 | |
| JP | 8-132809 | | 5/1996 | |
| JP | 8-268327 | | 10/1996 | |
| JP | 9-48286 | | 2/1997 | |

* cited by examiner

*Primary Examiner*—Thomas B. Will
*Assistant Examiner*—Kristine Markovich
(74) *Attorney, Agent, or Firm*—Crowell & Moring LLP

(57) ABSTRACT

A tired roller, which permits widening the field of view on both the left and right sides of an operator's section and is convenient for steering. In a tired roller with an operator's section arranged close to a right-hand side wall of a tired roller main body 11 and with an ingress-egress step 18 arranged on the tired roller main body 11, a space 20 for the arrangement of the ingress-egress step 18 is formed on the tired roller main body 11 at a position between a left-hand side wall and the operator's section. In the arrangement space 20, the ingress-egress step 18 which is provided with plural treads 21,22,23 is arranged extending aslant from the operator's section toward a lower part of the left-hand side wall, so that an operator 9 can look down at a road surface on the left side from the operator's section through a space above the treads 21,22,23. When the operator looks down at the road surface on the left side, conventional tired rollers allow him to see only a point Y significantly remote from the tired roller main body 11. This invention however makes it possible to see a point Z which is a point adjacent to the tired roller main body 11, whereby the field of view has been substantially enlarged on the left side.

4 Claims, 7 Drawing Sheets

TIRED ROLLER

TECHNICAL FIELD

This invention relates to a tired roller for finishing a paved surface of asphalt or the like by performing rolling compaction of the paved surface with rubber tires in the form of wheels.

BACKGROUND ART

A tired roller is a construction vehicle, which is equipped with rubber tires and is adapted to rolling-compact a paved surface of asphalt by the rubber tires. When applying asphalt paving, a roadbed which has not been paved with asphalt is first roughly finished by performing rolling compaction with a construction vehicle having steel wheels and then, a paved surface of asphalt is formed on the roadbed. The tired roller performs rolling compaction of the paved surface with the rubber tires to finish the paved surface. The present invention is to make improvements in such a tired roller so that steering of the tired roller can be facilitated. To facilitate the understanding of the present invention, fundamental technical details of a conventional general tired roller will now be described with reference to FIG. 7 through FIG. 10. FIG. 7 is a side view showing the overall image of the conventional general tired roller, FIG. 8 is a front view of the tired roller, FIG. 9 is a fragmentary cross-sectional view taken in the direction of arrow A of FIG. 7, and FIG. 10 is similar to FIG. 8 and will be referred to upon explanation of the field of view of an operator sitting in an operator's section.

Illustrated in FIG. 7 to FIG. 10 are a tired roller main body 1 as a self-traveling vehicle body capable of travelling by itself with rubber tires, a power transmitting system 2 for transmitting power to wheels, said power transmitting system including a prime mover, drive-axle tires 3 as rear wheels driven as a result of transmission of power from the power transmitting system 2, idle-axle tires 4 as front wheels, a seat 5 in the operator's section, said seat being arranged on the tired roller main body 1 at a position between the drive-axle tires 3 and the idle-axle tires 4, a steering wheel 6 arranged in the operator's section, a canopy 7 extending as a cover over the operator's section, and a ladder-like ingress-egress step 8 arranged in a vertical direction. The drive-axle tires 3 and the idle-axle tires 4 are all formed of rubber tires so that, when the tired roller main body 1 is caused to travel, they can rolling-compact and finish a paved surface of asphalt. Further, the drive-axle tires 3 and the idle-axle tires 4 are each constructed by mounting many tires, for example, three tires in the case of wide tires or four or five tires in the case of narrow tires on a drive axle or an idle axle to make up a tire train. To operate the tired roller, an operator on the seat 5 in the operator's section controls the direction of the idle-axle tires 4 via the steering wheel 6 while driving the drive-axle tires 3 by way of the power transmitting system 1. This makes it possible to travel to and from on roads or to travel on paved surfaces for rolling compaction.

The operator's section where the seat 5 is disposed is arranged close to one of side walls of the tired roller main body 1 for the convenience of travelling. In this conventional example, it is arranged close to the side wall on a right-hand side as viewed in an advancing direction of the tired roller so that its position is convenient for traveling on the left. On the other side wall of the tired roller main body 1 on the side opposite to the side close to which the operator's section is arranged, in other words, on the side wall on the left-hand side as viewed in the advancing direction of the tired roller, the ingress-egress step 8 is arranged. As is illustrated in FIG. 7 and FIG. 9, this ingress-egress step 8 has been constructed in the form of a vertical ladder by arranging recesses, which are inwardly convex to permit insertion of foot, on the left-hand side wall of the tired roller main body 1 at several locations with predetermined intervals left therebetween. The operator of the tired roller can therefore perform ingress or egress by vertically ascending or descending the ladder while inserting his feet into the recesses.

In such a conventional tired roller, the operator's section is arranged close to the right-hand side of the tired roller main body 1 as described above. The operator on the seat 5 in the operator's section can therefore easily check road surface conditions and the position and activities of each worker on the right-hand side by looking down at the road surface and workers from the operator's section. However, the conventional tired roller is accompanied by a problem in that the above-mentioned checking is difficult on the left-hand side where the ingress-egress step 8 is arranged. Described specifically, as is illustrated in FIG. 10, the operator 9, when looking down at the right-hand side, can entirely place within his visual field the space on an outer side of a line of sight which is drawn when he sees a point X, a point adjacent to the tired roller main body 1. When looking down at the left-hand side, on the other hand, he can place within his visual field only the space on an outer side of a line of sight which is drawn when he sees a point Y, a point substantially remote from the tired roller main body 1, because the operator's section is arranged close to the right-hand side of the tired roller main body 1 and, moreover, is arranged at a high level on a top wall of the tired roller main body 1. As is understood from the foregoing, in the case of the conventional tired roller, the field of view is wide only on one of the left-hand and right-hand sides of the operator's section and the field of view becomes extremely limited on the other side where the ingress-egress step is arranged. The conventional tired roller is therefore accompanied by the problem that its steering is difficult.

The present invention is intended to solve the above problem observed on such conventional tired rollers, and has as a technical object thereof the provision of a tired roller, which when an operator looks at a road surface, can assure wider fields of vision on both left-hand and right-hand sides of the operator's section and hence convenient steering, by arranging an ingress-egress step in a rational fashion.

DISCLOSURE OF THE INVENTION

The above-described technical object of the present invention can be achieved by a tired roller provided with a tire roller main body as a self-travelling vehicle body, an operator's section arranged close to one of side walls of the tired roller main body, and an ingress-egress step arranged on the tired roller main body, wherein "a space for the arrangement of the ingress-egress step is formed on the tired roller main body at a position between the operator's section and the other side wall on a side opposite to the side wall close to which the operator's section is arranged, and the ingress-egress step with plural treads provided therein is arranged in the space so that the ingress-egress step extends aslant from the operator's section toward a lower part of the other side wall, whereby a road surface on the side of the other side wall can be looked down from the operator's section".

Owing to the adoption of such technical features as mentioned above, the tired roller according to the present invention makes it possible to see a load surface at a point adjacent to the tired roller main body not only when looking down from the operator's section at the road surface on the side close to which the operator's section is arranged but also when looking down from the operator's section at the road surface on the opposite side. According to the tired roller of this invention, it is therefore possible to place the spaces, which are respectively on outer sides of lines of sight drawn when the road surface are looked at the points adjacent to the tired roller main body, entirely in the visual field, and hence to widen the field of view on each of the left-hand and right-hand sides of the operator's section. As a result, the operator in the operator's section can easily check both the left-hand side and the right-hand side by looking down at the conditions of the road surface and the position and activities of each worker from the operator's section.

BEST MODES FOR CARRYING OUT THE INVENTION

Figure 1:
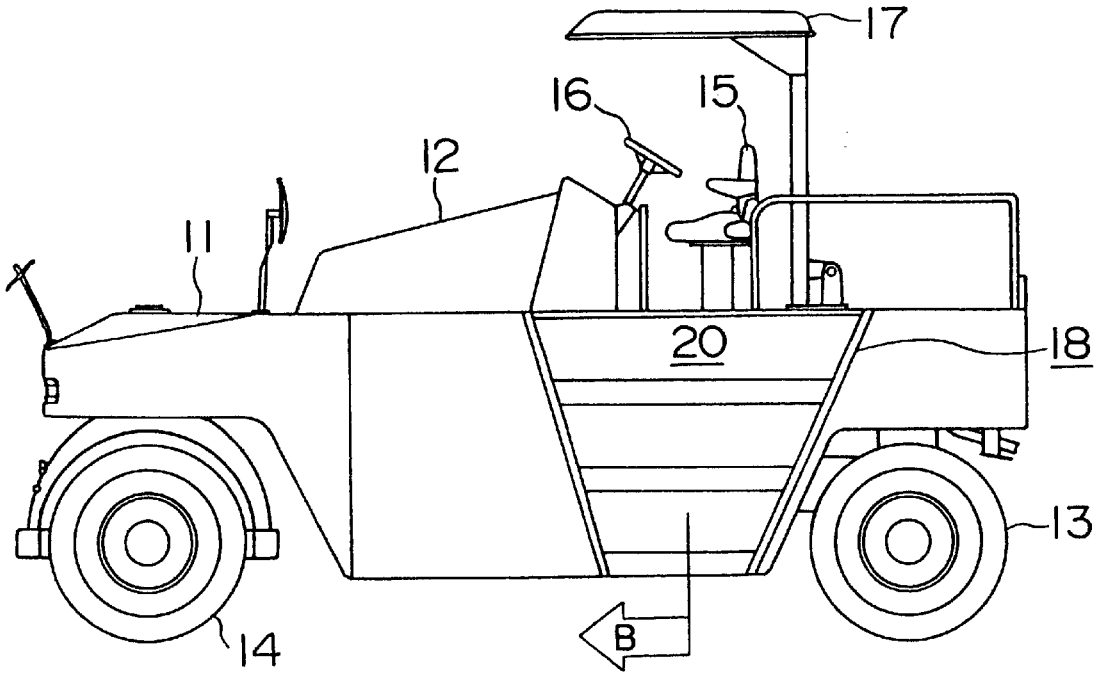
FIG. 1 is a side view showing the overall image of a tired roller according to a first embodiment of the present invention.
Figure 2:
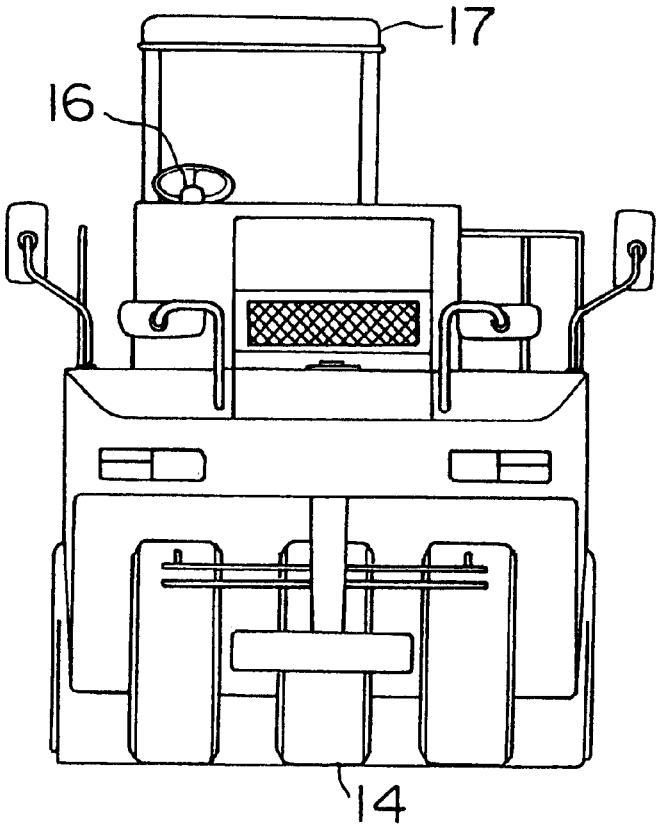
FIG. 2 is a front view of the tired roller of FIG. 1.
Figure 3:
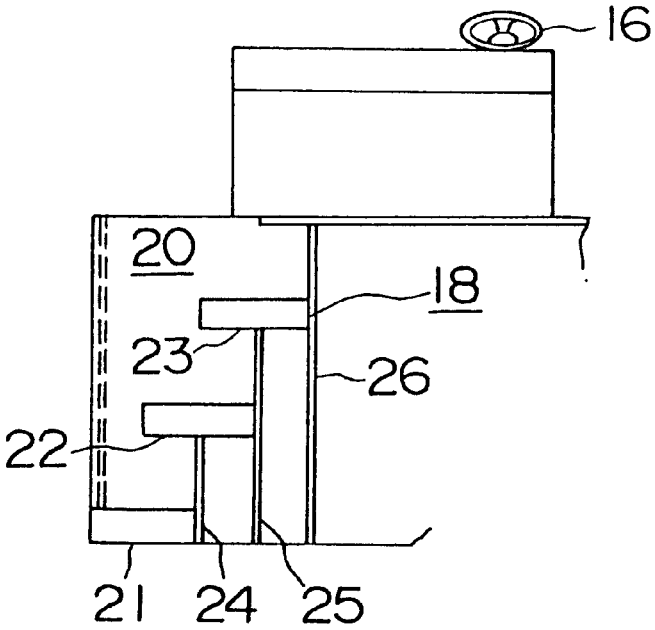
FIG. 3 is a fragmentary cross-sectional view as viewed in the direction of arrow B of FIG. 1.
Figure 4:
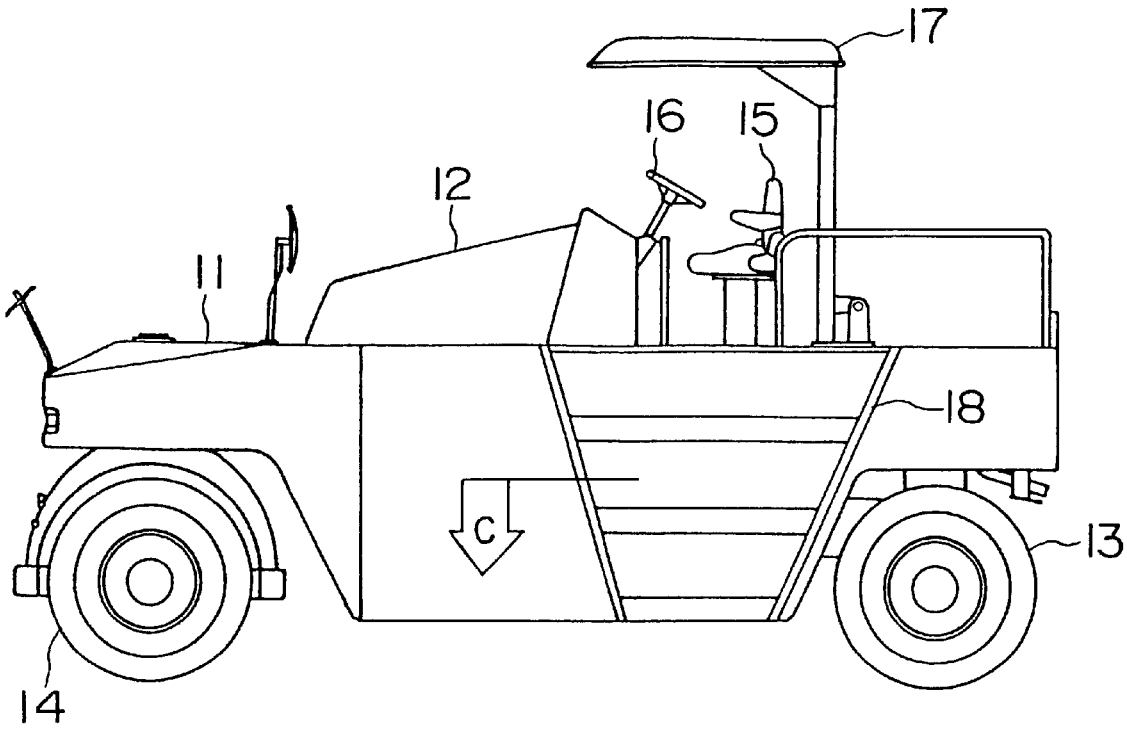
FIG. 4 is a side view depicting the overall image of a tired roller according to a second embodiment of the present invention.
Figure 5:
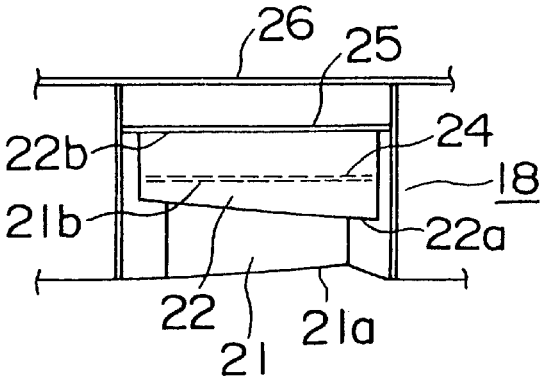
FIG. 5 is a fragmentary cross-sectional view as viewed in the direction of arrow C of FIG. 4.

Modes in which the present invention may be carried out will hereinafter be disclosed by describing the embodiments, which illustrate how the present invention can be embodied in practice, on the basis of FIG. 1 through FIG. 6. FIG. 1 is the side view showing the overall image of the tired roller according to the first embodiment of the present invention, FIG. 2 is the front view of the tired roller of FIG. 1, FIG. 3 is the fragmentary cross-sectional view as viewed in the direction of arrow B of FIG. 1, FIG. 4 is the side view depicting the overall image of the tired roller according to the second embodiment of the present invention, FIG. 5 is the fragmentary cross-sectional view as viewed in the direction of arrow C of FIG. 4, and FIG. 6 is the front view illustrating the essential part of the tired roller according to the first embodiment of the present invention by breaking it out to explain the field of view of the operator in the operator's section.

In these figures, there are shown a tire roller main body 11, a power transmitting system 12, drive-axle tires 13, idle-axle tires 14, a seat 15 in the operator's section, a steering wheel 16 in the operator's section, a canopy 17, and an ingress-egress step 18. Among these, the power transmitting system 12, the drive-axle tires 13, the idle-axle tires 14, the seat 15 in the operator's section, the steering wheel 16 in the operator's section and the canopy 17 are similar to the power transmitting system 2, the drive-axle tires 3, the idle-axle tires 4, the seat 5 in the operator's section, the steering wheel 6 in the operator's section and the canopy 7 in the above-described conventional general tired roller. The tired roller according to each embodiment of the present invention is provided, as a construction associated with the present invention, with the tired roller main body 11 as a self-travelling vehicle body, the operator's section arranged close to a right-hand side wall of the tired roller main body 11 and the ingress-egress step 18 arranged on the tired roller main body 11, and its basic construction is not different from the conventional general tired roller depicted in FIG. 7 through FIG. 10.

Figure 6:
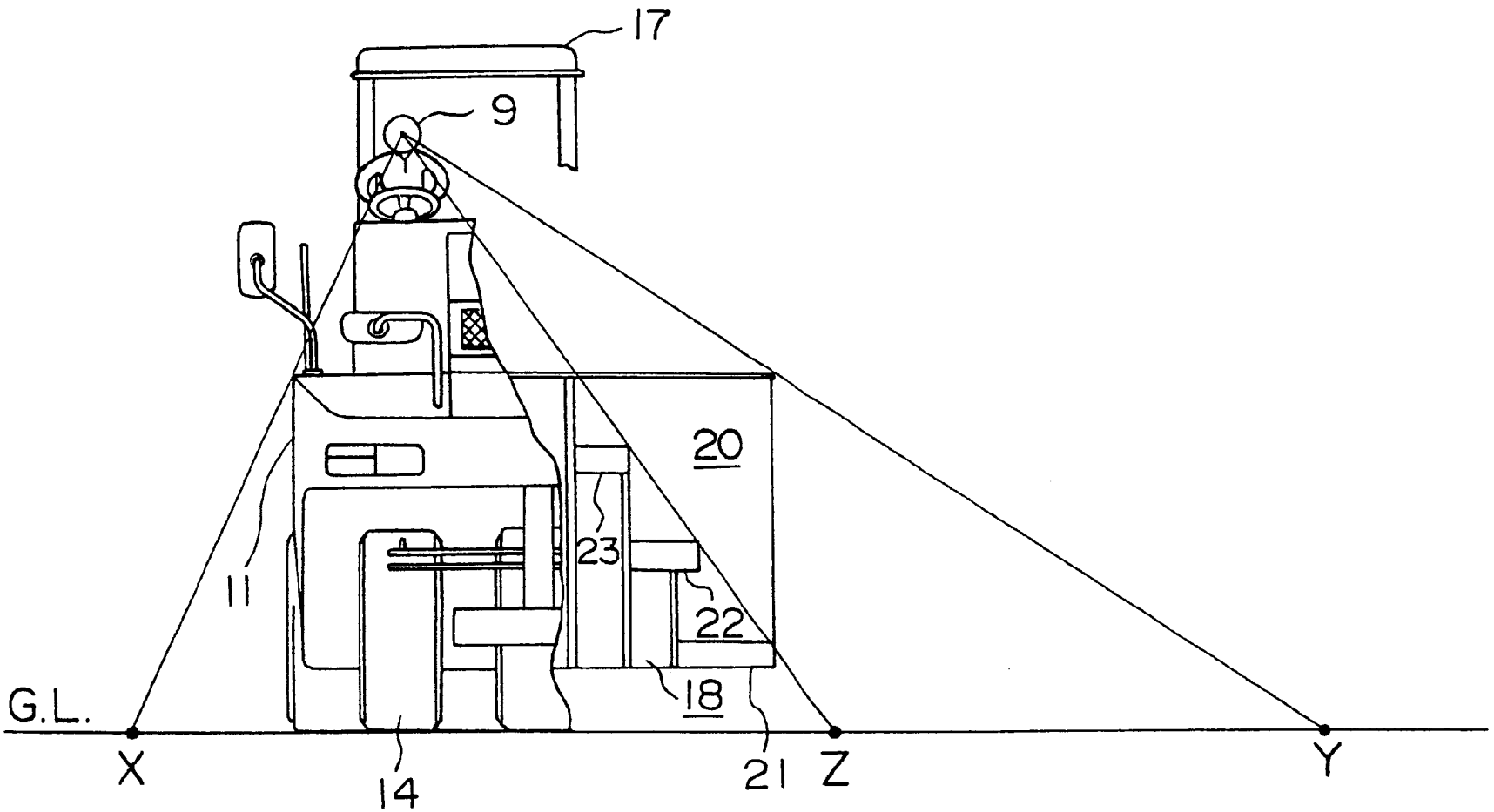
FIG. 6 is a front view illustrating an essential part of the tired roller according to the first embodiment of the present invention by breaking it out to explain the field of view of an operator in an operator's section.
Figure 7:
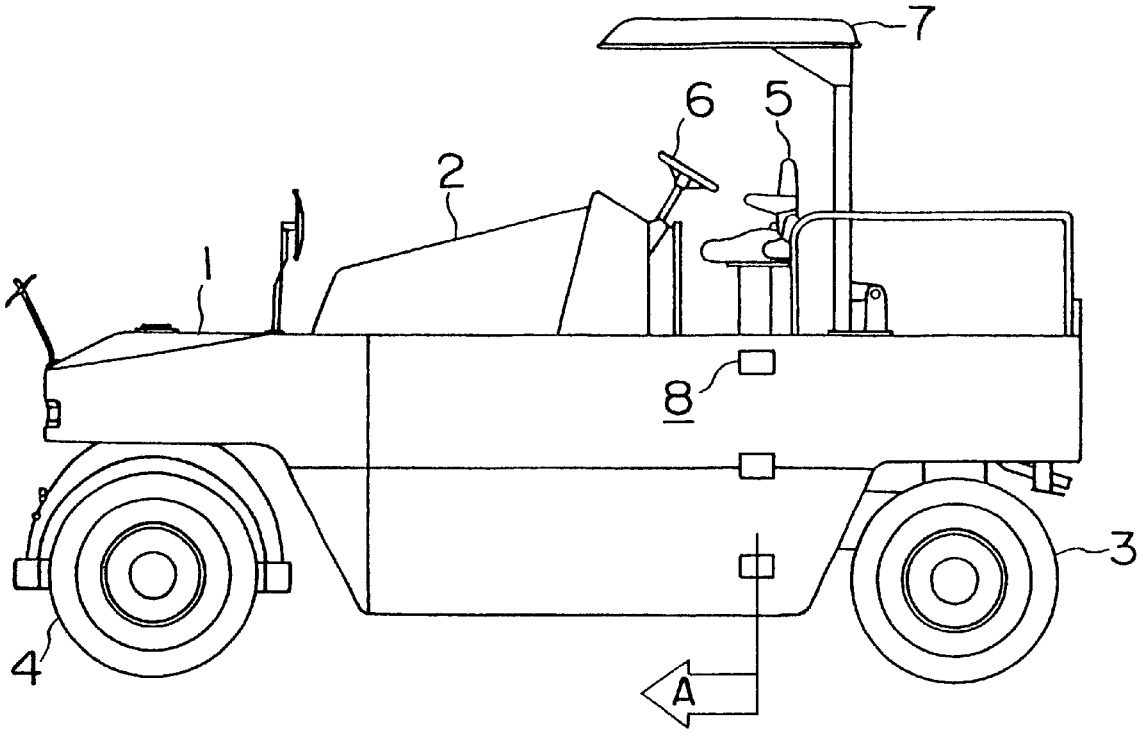
FIG. 7 is the side view showing the overall image of the conventional general tired roller.
Figure 8:
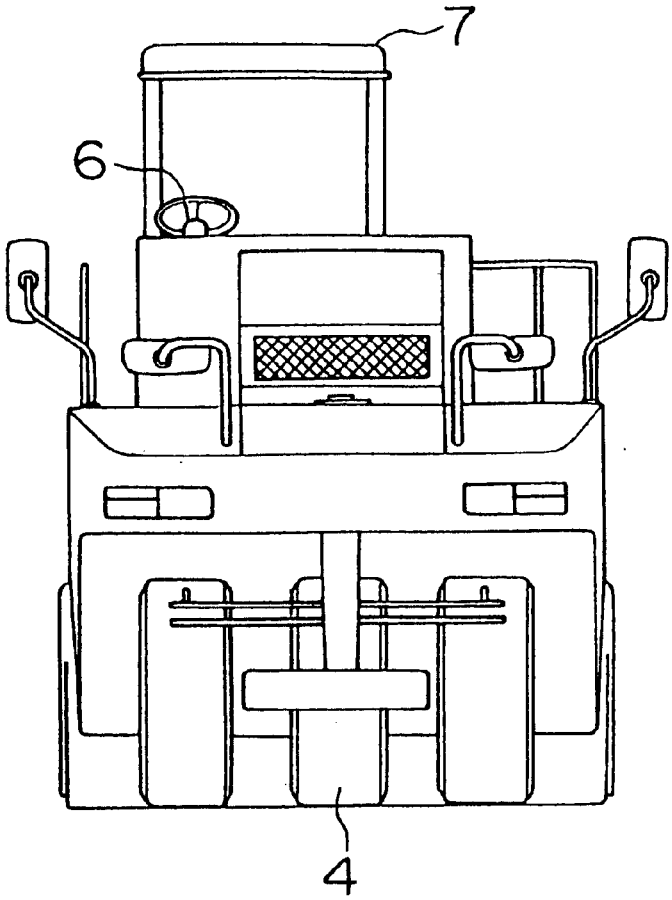
FIG. 8 is the front view of the tired roller of FIG. 7.
Figure 9:
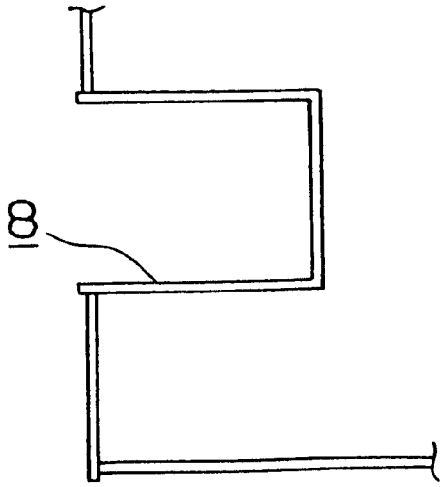
FIG. 9 is the fragmentary cross-sectional view taken in the direction of arrow A of FIG. 7.
Figure 10:
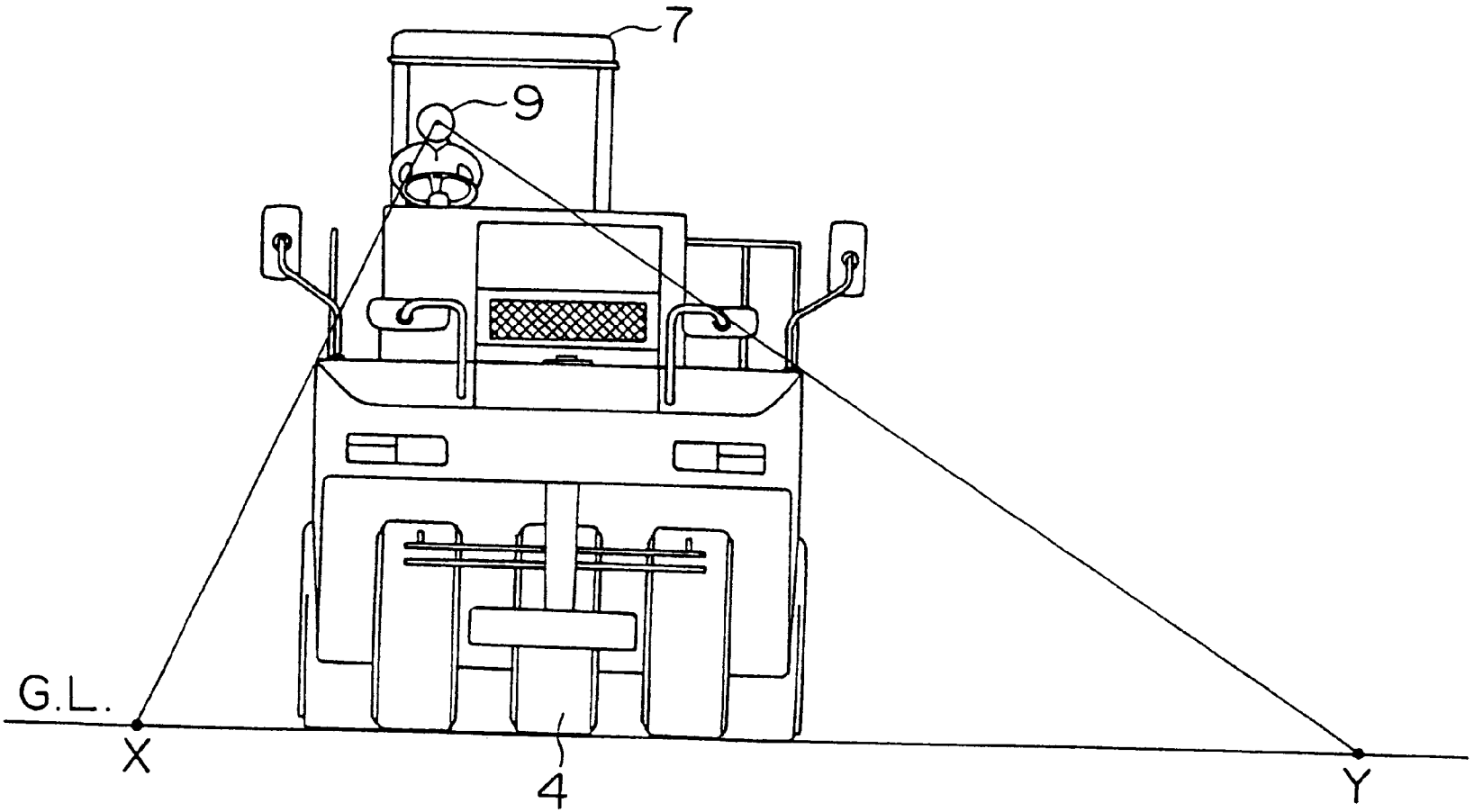
FIG. 10 is similar to FIG. 8 and was referred to upon explanation of the visual field of the operator in the operator's section.

Referring now to FIG. 1 through FIG. 6, a description will be made about certain technical features characteristic to the tired rollers according to the embodiments of the present invention. As has been described above, the conventional tired roller has the problem that its steering is difficult because the field of view is wide on only one of the left-hand and right-hand sides of the operator's section but is extremely limited on the other side where the ingress-egress step 8 is arranged. In the tired roller according to each embodiment of the present invention, this problem has been eliminated by modifying the structures of the tired roller main body 1 and the ingress-egress step 8 in each conventional general tired roller and arranging the ingress-egress step in a rational fashion. Described specifically, in each of the tired rollers according to the respective embodiments, a space 20 for the arrangement of the ingress-egress step 18 is formed on the tired roller main body 11 at a position between the operator's section and the other side wall on a side opposite to the side wall close to which the operator's section is arranged, the ingress-egress step 18 with plural treads 21,22,23 provided therein is also arranged by itself in a rational manner in the space so that the ingress-egress step extends aslant from the operator's section toward a lower part of the other side wall Further, the space 20 and the ingress-egress step 18 are arranged such that as is shown in FIG. 6, a road surface on the side of the other side wall can be looked down from the operator's section through a space above the treads 21,22,23 of the ingress-egress step 18 especially through a space immediately above a nosing 21*a* (see FIG. 5) of the lowermost tread 21. When the operator, who is on the seat 5 in the operator's section and is operating the tired roller, looks down upon the road surface on the side of the other side wall, the above-described arrangement of the space 20 and the ingress-egress step 18 makes it possible to have a point on the road surface close to the tired roller main body 11 enter within the operator's visual field through the space immediately above the nosing 21*a* of the lowermost tread 21. The operator, therefore, can directly see even those points on the road surface which are close to the tired roller main body 11, on both sides of the tired roller main body 11, during operation.

The first embodiment of the present invention, in which such technical features have been incorporated, will be described in detail. In the tired roller according to this embodiment, the space 20 for the arrangement of the ingress-egress step 18, said space having a vertical cross-section in a form flaring upward as depicted in FIG. 1 and a transverse cross-section in a rectangular form as shown in FIG. 3, is formed on the tired roller main body 11 at the position between the operator's section and the left-hand side wall. An upper part of this arrangement space 20 is formed with a width somewhat greater than that of the entrance to and exit from the operator's section for the convenience of ingress to and egress from the operator's section. Further, support plates 24,25,26 are arranged upright at predetermined intervals therebetween in the arrangement space 20 so that their heights become successively higher from the side of the left-hand side wall toward the operator's section in the tired roller main body 11, and the treads 21,22,23, which have rectangular shapes as viewed in plan, are supported by a floor in a lower part of the arrangement space 20 and the support plates 24,25,26. Accordingly, the tilted stair-like ingress-egress step 18 is formed, and is arranged in such a way that the ingress-egress step extends aslant from a position near the entrance to and exit from the operator's section toward the lower part of the left-hand side wall of the tired roller main body 11. As a result, an operator 9 on the seat 15 in the operator's section can look down at a road surface on the left side from the operator's section through the space above the treads 21,22, 23. In this embodiment, these treads 21,22,23 are formed especially with one on an upper side formed wider than one on a lower side so that the ingress-egress step takes an upwardly flared form to conform with the shape of the vertical cross-section of the arrangement space 20.

In the tired roller according to this embodiment, the space 20 for the arrangement of the ingress-egress step 18 is formed on the tired roller main body 11 at the position between the operator's section and the left-hand side wall which is the side wall on the side opposite to the side wall close to which the operator's section is arranged, the ingress-egress step 18 provided with the treads 21,22,23 is arranged in the arrangement space 20 so that the ingress-egress step extends aslant from the operator's section toward the lower part of the left-hand side wall, and the road surface on the left hand can therefore be looked down from the operator's section through the space above the treads 21,22,23. As is illustrated in FIG. 6, even when the operator 9 looks down at the left side, he can therefore see a point Z adjacent to the tired roller main body 1 so that the space on an outer side of a line of sight which is drawn when he sees the point Z can be placed within his visual field. Namely, when an operator looks down on the left hand, the above-described conventional tired roller allows, as shown in FIG. 6, to place within his visual field only the space on the outer side of the line of sight which is drawn when he sees the point Y remote from the tired roller main body 1. In contrast, the tired roller of this invention allows the operator to place a wide space within his visual field as in the case of looking down on the right side, whereby the field of view on the left side can be significantly enlarged. As a result, the operator 9 in the operator's section can easily check both the left and right sides by looking down at the road surface from the operator's section when the operator 9 looks at the road surface.

Therefore, the tired roller according to this embodiment can provide a wide field of view on each of the left and right sides of the operator's section, and the conditions of the surrounding area can be easily checked during operation. This is certainly convenient for steering. To actually bring about this advantage, the ingress-egress step 18, unlike the conventional ingress-egress step 8 in the form of a vertical ladder, is arranged in the form of a tilted stair on the tired roller main body 1. Accordingly, the ingress-egress step itself is arranged in a more rational fashion than the conventional one. As a result, the operator 9 can safely get off because the positions of the treads 21,22,23 can be confirmed with his own eyes no matter whether he gets off in a position facing toward or away from the ingress-egress step. Further, upon ingress, the operator can easily ascend the ingress-egress step 18 without requiring physical strength as much as the conventional tired roller. In addition, the treads 21,22,23 are formed especially with their widths broader on an upper side than on a lower side in this embodiment. This permits still easier ascent on the ingress-egress step 18 without slipping on the treads upon ingress and moreover, facilitates the ingress to and egress from the operator's section.

The second embodiment of the present invention will be described in detail. In the tired roller according to this embodiment, a space 20 for the arrangement of an ingress-egress step 18 is constructed in a similar fashion as in the first embodiment, and the tilted stair-like ingress-egress step 18 is arranged in the arrangement space 20 in a similar manner as in the first embodiment by forming the tilted stair-like ingress-egress step 18 with treads 21,22,23 and support plates 24,25,26 so that the ingress-egress step extends aslant from a position near the entrance or and exit from the operator's section toward a lower part of the left-hand side of the tired roller main body 11. Further, the treads 21,22,23 are formed especially with one on an upper side formed wider than one on a lower side so that the ingress-egress step takes an upwardly flared form. A characteristic feature of the tired roller according to the second embodiment resides in that, different from the conventional treads, the adjacent treads 21,22 out of the treads 21,22,23 are formed in trapezoidal shapes as viewed in plan as shown in FIG. 5. Namely, upon arrangement of the ingress-egress step 18 provided with the plural treads 21,22,23, the combination of the adjacent lower tread 21 and upper tread 22 is formed so that their nosing 21*a* and nosing 22*a* extend obliquely relative to their inner edge 21*b* and inner edge 22*b*, respectively, and the nosing 21*a* of the lower tread 21 and the nosing 22*a* of the upper tread 22 extend obliquely in opposite directions. As a result, step surfaces having large depths are formed on left and right sides on the treads 21,22, respectively. When the operator ascends or descends by alternately placing his respective feet on the left and right step surfaces of the large depths upon moving up or down on the ingress-egress step 18, the ingress-egress step can bring about advantageous effects similar to those available when ascending or descending an ingress-egress step 18 having wide step surfaces. As is understood from the foregoing, this embodiment makes it possible to practically enlarge the step surfaces of the ingress-egress step 18 and hence to use the ingress-egress step 18 still more conveniently. Incidentally, the uppermost tread 23 is formed in a shape similar to ordinary treads. It is however also possible to form the uppermost tread 23 with its nosing extending obliquely relative to its inner edge and to arrange it with its nosing extending obliquely in a direction opposite to the nosing 22*a* of the lower tread 22.

In each of the embodiments described above, the operator's section was arranged, by way of example, close to the right-hand side to be convenient for travelling on the left. However, each of the embodiments can also be applied to the case in which the operator's section is arranged close to the left-hand side to be convenient for travelling on the right. In this case, it is necessary to form the space 20 for the arrangement of the ingress-egress step 18 on the tired roller main body 11 at a position between the right-hand side wall opposite to the side wall close to which the operator's section is arranged and to arrange the ingress-egress step 18 in a similar manner as in the respective embodiments. Upon forming the space 20 for the arrangement of the ingress-egress step 18 in each of the embodiments, the space 20 was formed so that the vertical cross-section took the upwardly flaring form and the transverse cross-section took the rectangular form. The arrangement space 20 can however be formed in any manner insofar as, in essence, an ingress-egress step provided with plural treads can be arranged extending aslant from the operator's section toward the lower part of the side wall opposite to the operator's section and an operator can look down at a road surface on the side of the opposite side wall from the operator's section through a space above treads of the ingress-egress step.

Capability of Exploitation in Industry

As is evident from the above description, the present invention relates to a tired roller provided with a tire roller main body as a self-travelling vehicle body, an operator's section arranged close to one of side walls of the tired roller main body, and an ingress-egress step arranged on the tired roller main body, wherein "a space for the arrangement of the ingress-egress step is formed on the tired roller main body at a position between the operator's section and the other side wall on a side opposite to the side wall close to which the operator's section is arranged, and the ingress-egress step with plural treads provided therein is arranged in the space so that the ingress-egress step extends aslant from the operator's section toward a lower part of the other side wall, whereby a road surface on the side of the other side wall can be looked down from the operator's section". According to the present invention, it is therefore possible to make the field of view wider on both the left and right sides of the operator's section when an operator looks at the road surface and thus to obtain a tired roller convenient for steering. Further, the ingress-egress step itself is arranged in a more rational fashion than that in the conventional tired rollers. This permits safe egress and, upon ingress, the operator can easily ascend the ingress-egress step without requiring physical strength as much as that needed in the case of the conventional tired rollers.

Upon embodying the present invention, the adoption of the technical feature especially as described in claim 2 permits, in addition to the exhibition of the above advantageous effects, still easier ascend on the ingress-egress step without the potential danger of slipping the feet upon ingress and moreover, facilitates the ingress to and egress from the operator's section. In addition, the adoption of the feature described especially in claim 3 upon embodying the present invention makes it possible to practically enlarge the step surfaces of the ingress-egress step and hence to use the ingress-egress step still more conveniently.

What is claimed is:

1. A tired roller provided with a tired roller main body as a self-traveling vehicle body, said tired roller main body having at least three tires on each of a drive axle and an idle axle to perform rolling compaction and finishing of a paved surface, an operator's section arranged close to one of side walls of said tired roller main body, and an ingress-egress step arranged on said tired roller main body, wherein a space for said arrangement of said ingress-egress step is formed on said tired roller main body at a position between said operator's section and the other side wall on a side opposite to said side wall close to which said operator's section is arranged, said ingress-egress step with plural treads provided therein is arranged in said space so that said ingress-egress step extends aslant from said operator's section toward a lower part of the other side wall, and said space and said ingress-egress step are arranged such that said paved surface on said side of the other side wall can be looked down upon from said operator's section through a space immediately above a nosing of a lowermost one of said plural treads, thereby providing an operator with a wide field of view exactly to the left and right of the operator's section.

2. A tired roller according to clam 1, wherein upon arrangement of said ingress-egress step provided with said plural treads so that said ingress-egress step extends aslant from said operator's section toward said lower part of the other side wall, said plural treads are formed with one on an upper side formed wider than one on a lower side.

3. A tired roller according to claim 1, wherein upon arrangement of said ingress-egress step provided with said plural treads so that said ingress-egress step extends aslant from said operator's section toward said lower part of the other side wall, a combination of at least adjacent two treads out of said plural treads is formed so that nosings of said two treads extend obliquely relative to inner edges of said two treads, respectively, and said two treads are arranged so that said nosing of one of said two treads and said nosing of the other tread extend obliquely in opposite directions.

4. A tired roller according to claim 2, wherein upon arrangement of said ingress-egress step provided with said plural treads so that said ingress-egress step extends aslant from said operator's section toward said lower part of the other side wall, a combination of at least adjacent two treads out of said plural treads is formed so that nosings of said two treads extend obliquely relative to inner edges of said two treads, respectively, and said two treads are arranged so that said nosing of one of said two treads and said nosing of the other tread extend obliquely in opposite directions.

* * * * *